US007078656B2

(12) United States Patent
Herold et al.

(10) Patent No.: US 7,078,656 B2
(45) Date of Patent: Jul. 18, 2006

(54) DEVICE FOR ELECTRICALLY HEATING A VERTICALLY ERECT CHAMBER

(75) Inventors: Heiko Herold, Neuss (DE); Günter Holdenried, Leichlingen (DE); Leslaw Mleczko, Dormagen (DE); Matthias Pfaffelhuber, Baytown, TX (US); Theo König, Laufenburg (DE)

(73) Assignee: Solarworld Aktiengesellschaft, Bonn (DE)

( * ) Notice: Subject to any disclaimer, the term of this patent is extended or adjusted under 35 U.S.C. 154(b) by 0 days.

(21) Appl. No.: 10/481,762

(22) PCT Filed: Apr. 9, 2002

(86) PCT No.: PCT/EP02/03911

§ 371 (c)(1),
(2), (4) Date: Sep. 15, 2004

(87) PCT Pub. No.: WO03/001125

PCT Pub. Date: Jan. 3, 2003

(65) Prior Publication Data

US 2005/0236393 A1 Oct. 27, 2005

(30) Foreign Application Priority Data

Jun. 20, 2001 (DE) ..... 101 29 675

(51) Int. Cl.
*H05B 3/00* (2006.01)

(52) U.S. Cl. ..... 219/476; 219/390; 219/537; 219/542; 338/316; 338/319; 373/128

(58) Field of Classification Search ..... 219/476–478, 219/390, 541, 537, 532, 542, 548; 338/289–290, 338/294, 304–305, 316, 319, 295, 326; 373/125, 373/128

See application file for complete search history.

(56) References Cited

U.S. PATENT DOCUMENTS

| | | | |
|---|---|---|---|
| 2,004,976 | A | 6/1935 | Carleton |
| 4,095,974 | A | 6/1978 | Matovich |
| 4,577,093 | A | 3/1986 | Plard et al. |

*Primary Examiner*—John A. Jeffery
(74) *Attorney, Agent, or Firm*—McGlew & Tuttle, P.C.

(57) ABSTRACT

A device for electrically heating a vertically erect chamber comprising several heating zones arranged vertically one above the other. The components of the device, with the exception of the insulating components, are made from graphite materials. Each zone (Z) comprises a number of supports (1), arranged in an essentially even distribution around the chamber for heating, which simultaneously serve as electrical supplies for the heater, and the heater for each zone (Z) is fixed at one end and longitudinally displaceable at the other end.

34 Claims, 2 Drawing Sheets

DEVICE FOR ELECTRICALLY HEATING A VERTICALLY ERECT CHAMBER

FIELD OF THE INVENTION

The invention relates to a device for electrically heating a vertically erect chamber, for example a reactor, to high temperatures (≧1000° C.) and/or with high power (30 to 1000 kW per zone), comprising several heating zones arranged vertically one above the other and wherein the components of the device, with the exception of the insulating components, are made from graphite materials.

BACKGROUND OF THE INVENTION

High-temperature heatings made from graphite materials must be operated in a gasproof, air-free heating zone. The electrical supplies must be conducted through the wall of a dense and comparatively cold case.

Two-zone graphite heatings that are arranged one above each other, for vertically erect (reaction) chambers, can be arranged directly on top of each other separated from each other by insulating components. The electrical supplies of a heating zone, however, must be able to balance out the difference in length of the heater compared to the case caused by different thermal expansibility.

From the third heating zone on, however, the electrical supplies of the central heating zones must be conducted radially out of the heating zone. These can now be conducted radially and flexibly (by means of cooled metallic materials) through the side wall of the case or with large-design graphite electrical supplies outside the heating vertically upward or downward which, however, requires flexible, metallic connections. Particularly in the case of very big heaters (e.g. up to 10 m height) lateral connection causes great problems during assembly.

In the case of large-design high-power heaters which are often operated at low voltage (with the consequence of even bigger-and heavier-dimensioned parts) the electrical supplies of the heating zones that are arranged one above the other are very heavy and the whole construction becomes mechanically more and more unstable the higher the construction is and high Carbon Fiber Composite (CFC) heating elements can no longer carry the weight of the above heating zones with their electrical supplies. Therefore subframes become necessary for the individual heating zones comprising separate supports resting outside the heating.

SUMMARY AND OBJECTS OF THE INVENTION

The object of the invention is therefore to further embody and develop the initially mentioned device for electrically heating a vertically erect chamber such that the largest possible degree of stability and functional capability for the whole device is achieved with low constructional complexity.

This object is achieved in a device for electrically heating a vertically erect chamber to a high temperature and with high power, comprising several heating zones arranged vertically one above the other and each being provided with an electrical supply, in that each zone is surrounded by a plurality (twice or in the case of a three-phrase heating 3 times the number of zones) of supports 1, arranged in an essentially even distribution around the chamber R for heating and the heaters, consisting of heating elements 6 and heating element connectors 7, wherein 2 or 3 of such supports simultaneously serve as electrical supplies for the heaters of each zone Z, and wherein the heaters for each zone Z are arranged such as to be fixed ax one end thereof and longitudinally displaceable at the other end thereof.

The inventive construction of such a tall, high (up to approx. 10 meters), multi-zone (Z≧2) high-power heater made from graphite materials provides the following advantages:

- the use of the supports of the subframe as electrical supplies,
- the possibility of a vertically erect heating construction without electrical supplies that need to vary in length,
- the extension of the heating elements of the individual heating zones without affecting the other zones,
- the possibility to pre-assemble the individual heating zones and to arrange them one above the other during final assembly.

A further teaching of the invention provides that the heaters are longitudinally displaced by means of the guide pins 11 that are located on the surface opposite of the electrical supplies (joining elements 8 or 9) of the heaters. This ensures that the heating elements 6 can expand within their respective zone irrespective of the surrounding subframe.

According to another embodiment of the invention the sole plates 4 of each zone are connected electrically conductive to the supports 1 by the joining elements 2 and they are connected electrically insulating to the supports 1 by the joining elements 3, whereby each sole plate 4 is partitioned in two or three (in case of a three-phase heating) electrically separate areas.

A precondition to the construction of the heating according to the invention is that the electrical supplies of the heaters of the individual heating zones are located on the same level (on top or near the bottom). This can be achieved by at least three arrangements of the heating elements 6: By means of a 1-phase heating (2 electrical supply points) of 2n (n≧1) serially connected groups of i (i≧1 (with i=1: all in series)) parallel-connected heating elements or as a meander of one piece or as a three-phase heating (3 electrical supply points) in radial connection (electrical supply points are located on one level and the connections of the 3 heating element groups (also groups of i parallel connected heating elements) are located on the second level (for example supply points near the bottom and joining elements on top) or triangle connection, where the three heating resistors consist of 2n (n≧1) serially connected groups of i (i≧1 (with i=1: all in series)) parallel connected heating elements.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
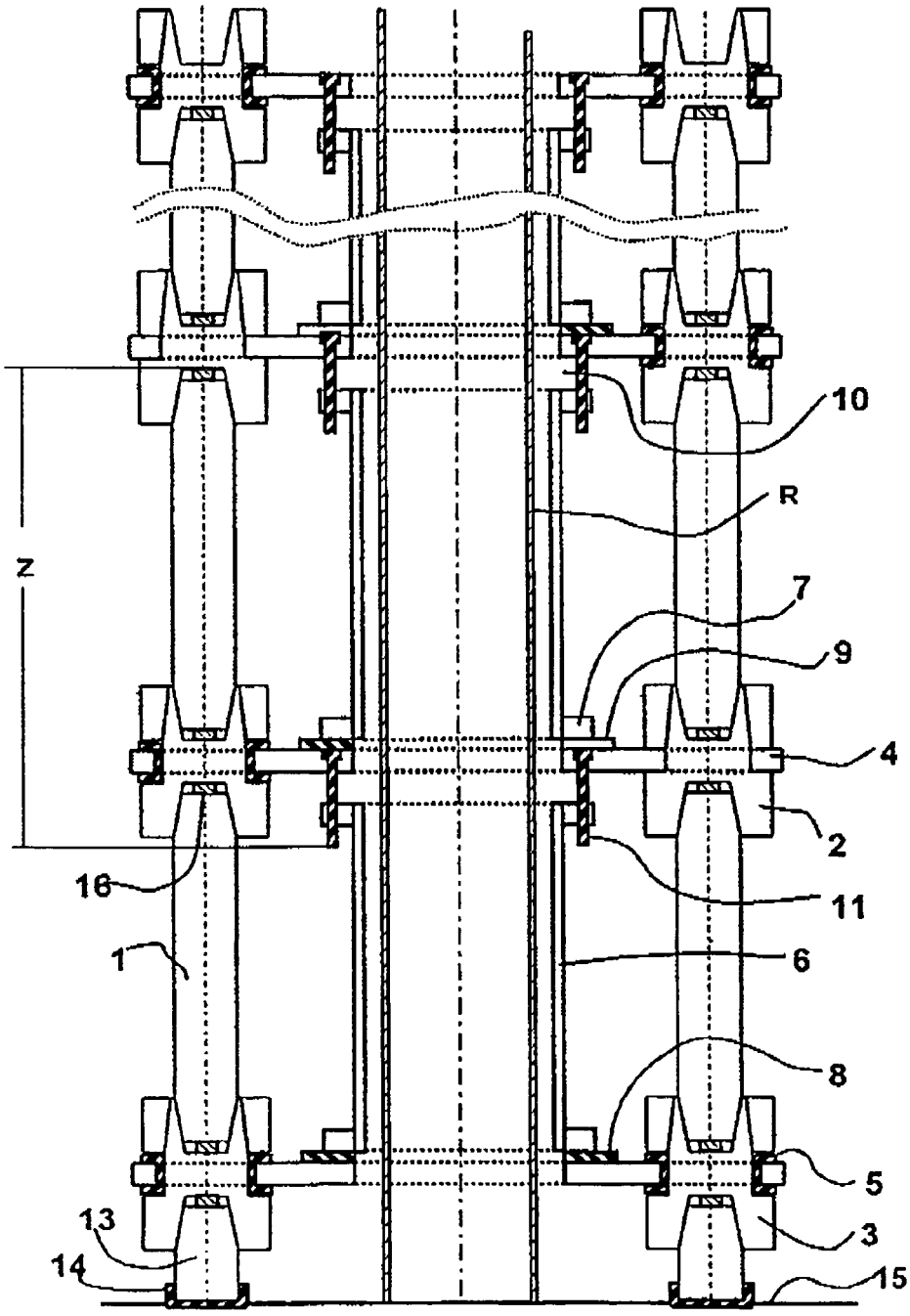
FIG. 1 is a schematic illustration of the device according to the invention in vertical cross-section.
Figure 2:
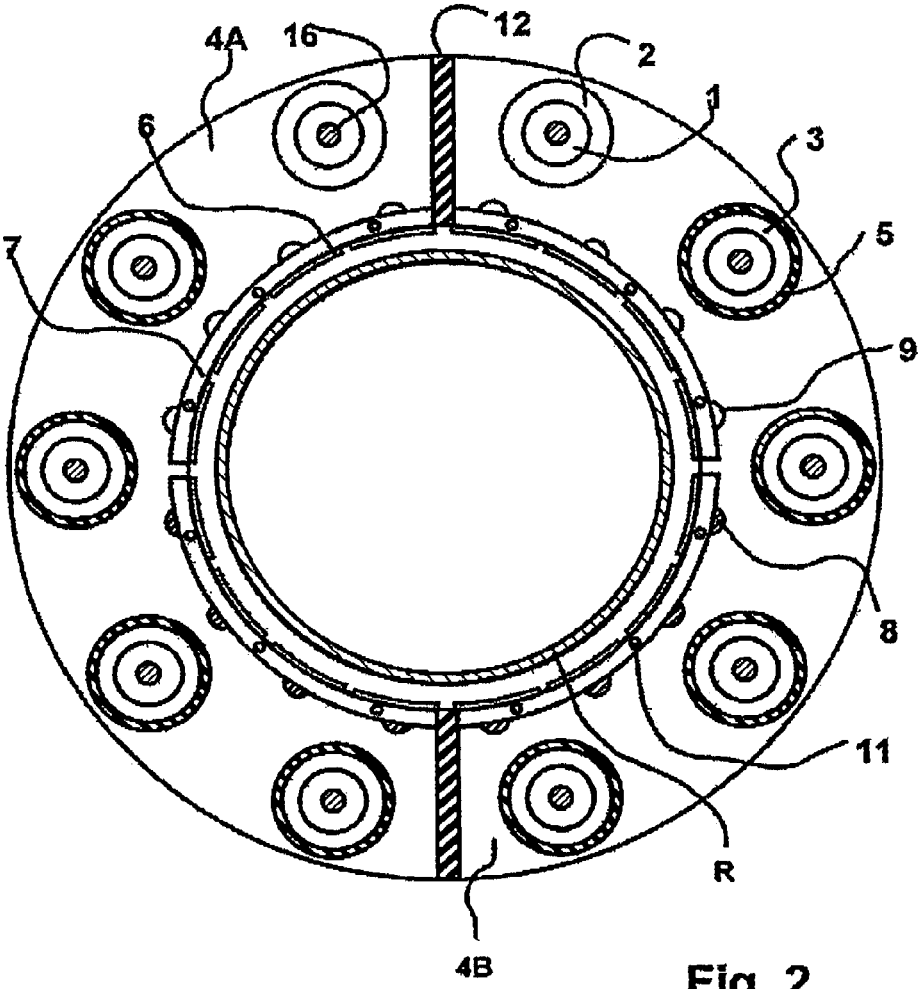
FIG. 2 is a schematic illustration of the device according to the invention in horizontal projection (the lower level of a heating zone).

The illustrated embodiment depicts the basic structure of a device for electrically heating a vertically erect chamber by means of a 5-zone 1-phase heating, comprising vertically erect heaters with four serially connected groups of heating elements (n=2) of four parallel connected heating elements each (i=4) (for reason of transparency the joining elements (one near the bottom and two on top) between the groups of heating elements are omitted in FIGS. 1 and 2). The heating elements 6 of the heaters (total number of 2n times i heating elements 6, the appropriate 2n times 2 heating element connectors 7 and the 2n−1 joining elements of the groups of heating elements) are displayed as CFC strips in the illustration, it is also possible, however, to use for example heating rods or heating tubes. CFC heating elements with a large surface are preferred for example where the power density and/or the temperature on the heating elements must be restricted.

As the 10 electrical supplies of the 5 heating zones are simultaneously used as supports each of them is lead up to the upper end of the fifth heating zone independent of the actual installation height of the respective heating zone. Each of the supports 1 consists of sections which are mechanically and electrically connected with each other by means of the joining elements 2 or 3. The height of a support 1 and a joining element 2 or 3 determine the height of a heating zone Z.

A ring-shaped sole plate 4 is attached to the 10 joining elements 2 and 3 of each level. Located on top of such sole plates 4 are the heaters of each heating zone, e.g. the heating elements 6 and their heating element connectors 7. The heaters for each heating zone are fixed at one end to the sole plate 4 on which they are located on by means of joining elements 8 and 9. The ring-shaped sole plates 4 are divided in two electrically insulated semi-rings 4A and 4B by means of electrically nonconductive insulating components 12. It is divided in a way such that the semi-rings are connected to each other with one joining element 2 electrically conductive and with four joining elements 3 electrically insulating (by insulation ring 5).

The four heating element connectors 7 of the heaters stand upon the semi-rings 4A and 4B of the sole plates by means of conductive and insulating joining elements 9 and 8. The sole-plate semi-rings 4A are connected electrically conductive with the first, sole-plate semi-rings 4B with the last heating element connectors 7 (by means of conductive joining elements 9) and with the two central heating element connectors 7 electrically insulating (by means of nonconductive joining elements 8). The heating element connectors 7 are connected with other joining elements (not displayed in the drawing) such that a serial connection is established with the groups of heating elements (with i=4 heating elements) formed by the heating element connectors 7.

At the upper end the heaters with their four heating element connectors 7 are guided in insulating guide pins 11 that are attached to or in the sole plate 4 of the heating zone Z located above. The heaters are longitudinally displaceable at their upper ends by the guide pins 11. This ensures that the heaters can expand within their respective zone irrespective of the surrounding subframe.

The length of the supports 1 is dimensioned such that a sufficient expansion gap 10 is formed. This allows to compensate the different thermal expansibility of the supports 1 and the heaters without affecting the other heating zones and/or the whole construction.

The five identically designed heating zones Z (which can however be varied, for example to adapt the heating performance of the heating elements 6 of the heaters) are put one above the other in a way that the sole plates 4 are each rotated by 72° (360°/5) connecting each of the heating zones Z with two other supports 1 electrically conductive. To complete the upper-most heating zone another set (in the depicted embodiment 10 pieces) of nonconductive joining elements 3 and a sole plate 4 must be put on top.

The lowermost heating zone of the whole heating which is electrically and thermally decoupled by the insulating components 14, rests on the shorter supports 13 (analogous to supports 1) on the sole plate 15 of the whole construction. For power supply the supports 13 can now be conducted directly through the sole plate 15 or can be rigidly connected by separate power connections (both not displayed in the drawing).

In the displayed and in so far preferred embodiment the heating elements 6 are arranged vertically erect. However, a suspended arrangement is also possible, in that the electrical supplies with the joining elements 8 and 9 would be arranged in the upper area and the expansion gap 10 near the bottom.

Other designs of the heating elements 6, e.g. one-piece CFC meanders, may provide heating element connectors 7 and joining elements 8 and 9 which are partly or completely combined in one piece.

The most different graphite materials can be used to construct the heating specified above. Because of the required high stability it will be expedient, however, to make the sole plates 4 from CFC materials and the joining elements 2 and 3 from isostatically pressed finest-corn graphites of highest solidity.

Depending on the intended use and temperature the insulating construction parts are made for example from $Al_2O_3$, BN or AlN.

According to a further teaching of the invention the fit between the joining elements 2 and/or 3 and the supports 1 is carried out conically. Such conical connection does not only ensure a very good electrical connection and an easy construction, but is in general the precondition for putting the individual heating zones Z above each other, which advantageously should be pre-assembled. According to the invention, in order to limit the radial forces occurring in a conical fit to an extent that the joining elements 2 and 3 do not break (the solidities of the best types of graphite are very low compared to metallic materials), the axial forces are restricted by installing compressible packs 16 (dimensioned according to the forces to be expected) made from expanded graphite, e.g. "Sigraflex®" made by the company SGL Carbon between the joining elements 2 and the supports 1 and 13. The angle of the conical fit which needs to be machined very precisely should be dimensioned such that no automatic interlocking may occur any longer.

For practical reasons the pre-assembly of the individual heating zones should be carried out on an assembly platform, consisting of the properly arranged upper parts of the 2n supports 13, on top of which the joining elements 2 and 3 with their insulation rings 5, the sole plate 4 with the guide pins 11 and the insulating components 12 and subsequently the supports 1 are mounted. The heating elements 6 with their heating element connectors 7 can then be assembled-on the sole plate 4 and the joining elements 8 and 9. Other components such as e.g. thermoelement retainers and beam umbrellas (not displayed) can also be installed. For the assembly of the heaters appropriate templates can be stuck on the supports 1. The pre-assembled heating zones Z can now be rotated by 72° and mounted on the heating zone located below using a divisible auxiliary frame with a traverse part engaging below the joining elements 2 and 3, so that the guide pins 11 are pushed into the corresponding holes in the heating element connectors 7 of the heating zone below.

What is claimed is:

1. A device for electrically heating a vertically erect chamber, to a high temperature and with high power, comprising several heating zones arranged vertically one above the other and each being provided with an electrical supply, characterized in that each zone comprises a number of supports arranged in an essentially even distribution around the chamber for heating, said supports simultaneously serving as electrical supplies for heaters for each said zone, including heating elements and heating element connectors, and that the heater for each zone is fixed at one end thereof and longitudinally displaceable at the other end thereof, wherein said heaters are longitudinally displaced by means of guide pins that are located opposite of the electrical supplies.

2. A device according to claim 1, characterized in that the heaters for each zone are arranged on a sole plate and that each sole plate is partitioned in at least one of two and three electrically separate areas.

3. A device according to claim 2, characterized in that the sole plates are electrically connected to all supports in one level by means of joining elements.

4. A device according to claim 1, characterized in that the joining elements connect two supports at a time that are arranged one above the other.

5. A device according to claim 3, characterized in that the joining elements and the ends of the supports are provided with a conical fit.

6. A device according to claim 5, characterized in that the angle of the conical fit is dimensioned such that no automatic inter-locking occurs.

7. A device according to claim 3, characterized in that compressible packs made from expanded graphite are provided to restrict the forces occurring between the joining elements and the supports.

8. A device according to claim 1, characterized in that the supports are made from graphite material.

9. A device according to claim 2, characterized in that the sole plates are made from Carbon Fiber Composite materials.

10. A device according to claim 3, characterized in that the joining elements are made from isostatically pressed finest-corn graphites of highest solidity.

11. A device according to claim 1, characterized in that insulating construction parts are made from $Al_2O_3$, BN or AlN.

12. A device according to claim 1, characterized in that each zone comprises a pre-assembled unit comprising a sole plate with insulating components, joining elements with insulation rings, heating elements with heating element connectors, joining elements, guide pins and supports.

13. A device for electrically heating a vertically erect chamber, to a high temperature and with high power, comprising several heating zones arranged vertically one above the other and each being provided with an electrical supply, characterized in that that each zone comprises a number of supports arranged in an essentially even distribution around the chamber for heating, characterized in that that each zone comprises a number of supports arranged in an essentially even distribution around the chamber for heating, said supports simultaneously serving as electrical supplies for heaters for each zone, including heating elements and heating element connectors, and that the heater for each zone is fixed at one end thereof and longitudinally displaceable at the other end thereof, wherein said heaters for each zone are arranged on a sole plate and each sole plate is partitioned in at least one of two and three electrically separate areas, wherein said sole plates are electrically connected to all supports in one level by means of joining elements, wherein compressible packs made from expanded graphite are provided to restrict the forces occurring between the joining elements and the supports.

14. A device according to claim 13, characterized in that the heaters are longitudinally displaced by means of guide pins that are located opposite of the electrical supplies.

15. A device according to claim 13, characterized in that the joining elements connect two supports at a time that are arranged one above the other.

16. A device according to claim 13, characterized in that the joining elements and the ends of the supports are provided with a conical fit.

17. A device according to claim 16, characterized in that the angle of the conical fit is dimensioned such that no automatic interlocking occurs.

18. A device according to claim 13, characterized in that the supports are made from graphite material.

19. A device according to claim 13, characterized in that the sole plates are made from Carbon Fiber Composite materials.

20. A device according to claim 13, characterized in that the joining elements are made from isostatically pressed finest-corn graphites of highest solidity.

21. A device according to claim 13, characterized in that insulating construction parts are made from Al2O3, BN or AlN.

22. A device according to claim 13, characterized in that each zone comprises a pre-assembled unit comprising a sole plate with insulating components, joining elements with insulation rings, heating elements with heating element connectors,joining elements, guide pins, and supports.

23. A device for electrically heating a vertically erect chamber, to a high temperature and with high power, comprising several heating zones arranged vertically one above the other and each being provided with an electrical supply, characterized in that that each zone comprises a number of supports arranged in an essentially even distribution around the chamber for heating, characterized in that that each zone comprises a number of supports arranged in an essentially even distribution around the chamber for heating, said supports simultaneously serving as electrical supplies for heaters for each zone, including of heating elements and heating element connectors, and that the heater for each zone is fixed at one end thereof and longitudinally displaceable at the other end thereof wherein each zone comprises a pro-assembled unit comprising a sole plate with insulating components, joining elements with insulation rings, heating elements with heating element connectors, joining elements, guide pins, and supports.

24. A device according to claim 23, characterized in that the heaters are longitudinally displaced by means of guide pins that are located opposite of the electrical supplies.

25. A device according to claim 23, characterized in that the heaters of each zone are arranged on a sole plate and that each sole plate is partitioned in at least one of two and three electrically separate areas.

26. A device according to claim 23, characterized in that the sole plates are electrically connected to all supports in one level by means of joining elements.

27. A device according to claim 23, characterized in that the joining elements connect two supports at a time that are arranged one above the other.

28. A device according to claim 23, characterized in that the joining elements and the ends of the supports are provided with a conical fit.

29. A device according to claim 28, characterized in that the angle of the conical fit is dimensioned such that no automatic interlocking occurs.

30. A device according to claim 23, characterized in that compressible packs made from expanded graphite are provided to restrict the forces occurring between the joining elements and the supports.

31. A device according to claim 23, characterized in that the supports are made from graphite material.

32. A device according to claim 23, characterized in that the sole plates are made from Carbon Fiber Composite materials.

33. A device according to claim 23, characterized in that the joining elements are made from isostatically pressed finest-corn graphites of highest solidity.

34. A device according to claim 23, characterized in that insulating construction parts are made from Al2O3, BN or AlN.

* * * * *